US010126003B2

(12) United States Patent
Nezu et al.

(10) Patent No.: US 10,126,003 B2
(45) Date of Patent: Nov. 13, 2018

(54) OUTDOOR UNIT OF AIR CONDITIONER

(71) Applicant: FUJITSU GENERAL LIMITED, Kawasaki-shi, Kanagawa-ken (JP)

(72) Inventors: Kenta Nezu, Kawasaki (JP); Satoshi Kasugai, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 15/423,091

(22) Filed: Feb. 2, 2017

(65) Prior Publication Data

US 2017/0248330 A1 Aug. 31, 2017

(30) Foreign Application Priority Data

Feb. 29, 2016 (JP) ..... 2016-037417

(51) Int. Cl.
*F24F 1/50* (2011.01)
*F24F 1/38* (2011.01)
*F24F 1/46* (2011.01)

(52) U.S. Cl.
CPC ..... *F24F 1/50* (2013.01); *F24F 1/38* (2013.01); *F24F 1/46* (2013.01)

(58) Field of Classification Search
CPC ..... F24F 1/06; F24F 1/18; F24F 1/46; F24F 1/48; F24F 13/20; F24F 1/50; F24F 1/38
See application file for complete search history.

(56) References Cited

U.S. PATENT DOCUMENTS

2016/0054011 A1* 2/2016 Katayama ..... F24F 1/38 415/175

FOREIGN PATENT DOCUMENTS

JP 3710874 B2 10/2005
JP 2008138951 A * 6/2008

OTHER PUBLICATIONS

JP 2008138951 A translation.*

* cited by examiner

*Primary Examiner* — Elizabeth J Martin
(74) *Attorney, Agent, or Firm* — Manabu Kanesaka

(57) ABSTRACT

Provided is an outdoor unit of an air conditioner capable of obtaining stable air blowing performance without enlarging a blower fan and decreasing the amount of air per unit area (wind velocity distribution) passing through the heat exchanger even if the capacity of the heat exchanger is enlarged by optimizing a relative arrangement and a configuration of a heat exchanger and a blower and effectively utilizing the wind of the blower which is conventionally wasted. The rotation shaft of the first blower is disposed closer to the center line in the lateral direction of the housing than the center line in a lateral direction of the left blower chamber, and the rotation shaft of the second blower is disposed closer to the center line in the lateral direction of the housing than the center line in a lateral direction of the right blower chamber.

4 Claims, 8 Drawing Sheets

EXAMPLE

COMPARATIVE EXAMPLE

OUTDOOR UNIT OF AIR CONDITIONER

RELATED APPLICATIONS

The present application is based on, and claims priority from, Japanese Application No. JP2016-037417 filed Feb. 29, 2016, the disclosure of which is hereby incorporated by reference herein in its entirety.

BACKGROUND OF THE INVENTION

1. Field of the Invention

The present invention relates to an outdoor unit of an air conditioner, more specifically, to an outdoor unit of an air conditioner in which a blower chamber is disposed above a machine chamber having a heat exchanger and a compressor.

2. Description of Related Art

As one of an air conditioner, there is a multi-type air conditioner in which a plurality of indoor units are connected to one outdoor unit. For example, as described in Japanese Patent No. 3710874, the outdoor unit of the air conditioner includes a horizontally elongated rectangular parallelepiped housing, and the interior of the housing is partitioned into a machine chamber having a heat exchanger and a compressor, and a blower chamber including a blower. The machine chamber is disposed in the lower portion of the housing, the blower chamber is disposed in the upper portion of the machine chamber, and the air blowing port of the blower is disposed on the top surface of the housing.

When viewed a lateral direction of the housing from front, a left half space of the machine chamber is defined as a left machine chamber, a right half space of the machine chamber is defined as a right machine chamber, the left half space of the blower chamber is defined as a left blower chamber, and the left half space of the blower chamber is defined as a right blower chamber, a first heat exchanger is disposed in the left machine chamber, a second heat exchanger is disposed in the right machine chamber, a first blower is disposed in the left blower chamber, and a second blower is disposed in the right blower chamber.

In Japanese Patent No. 3710874, both the first and the second heat exchangers are formed in a U-shape, and are disposed on a base plate (referred to as a chassis) so that open ends thereof face each other. The compressor is disposed in the machine chamber so as to be surrounded by two heat exchangers.

An air blowing port of the first blower and an air blowing port of the second blower are respectively disposed at symmetrical positions on the top surface of the housing with a center line in the lateral direction of the housing being interposed therebetween. Furthermore, the air blowing port of the first blower is disposed at the center in the front, rear, right and left of the left blower chamber, and the air blowing port of the second blower chamber is disposed at the center in the front, rear, right and left of the second blower chamber.

However, in a case where the blower is disposed in this manner, the amount of air passing through a front portion, a side portion, and a rear portion of the heat exchanger is not uniform, and a portion of the wind is wasted without being able to sufficiently exhibit possible performance of the blower. Meanwhile, although in order to increase the output of the outdoor unit, it is required to further enlarge the size of the chassis as the capacity of the heat exchanger increases, in a case where only the heat exchanger is enlarged in size without changing the size and arrangement of the blower fan, there is a possibility to further decrease the amount of air per unit area passing through between fins of the heat exchanger at the same rotation speed. In addition, although it is required to increase the rotation speed of the motor in order to obtain the same amount of air, current consumption inevitably increases as the rotation speed increases.

In order to solve the problem described above, a method of enlarging the size (enlarge in diameter) of the blower fan according to the size of the housing may be considered. However, the enlarging of the size of the blower fan causes the load on the motor and power consumption to increase, and thus this method is not preferable. In addition, when the size of the motor is increased together, it is required to reinforce the housing side, so that it is inevitable to increase an assembly man-hour and to increase a cost. In any case, it is not changed that the wind of the blower is partially wasted.

SUMMARY OF THE INVENTION

Therefore, an object of the present invention is to provide an outdoor unit of an air conditioner capable of obtaining stable air blowing performance without enlarging a blower fan and decreasing the amount of air per unit area (wind velocity distribution) passing through the heat exchanger even if the capacity of the heat exchanger is enlarged by optimizing a relative arrangement and a configuration of a heat exchanger and a blower and effectively utilizing the wind of the blower which is conventionally wasted.

An outdoor unit of an air conditioner according to an aspect of the present invention is the outdoor unit of an air conditioner including a housing, in which an interior of the housing is partitioned into a machine chamber having a heat exchanger and a compressor, and a blower chamber disposed at an upper portion of the machine chamber and having a blower, the left half of the blower chamber is defined as the left blower chamber and the right half thereof is defined as the right blower chamber with a center line in a lateral direction of the housing being interposed therebetween, a first blower is disposed in the left blower chamber, a second blower is disposed in the right blower chamber, an air blowing port of the first blower and an air blowing port of the second blower are symmetrically disposed on a top surface of the housing with the center line in the lateral direction of the housing being interposed therebetween, the rotation shaft of a fan in the first blower is disposed closer to the center line in the lateral direction of the housing than the center line in a lateral direction of the left blower chamber, and the rotation shaft of a fan in the second blower is disposed closer to the center line in the lateral direction of the housing than the center line in a lateral direction of the right blower chamber.

As a more preferred aspect, when the center line in the lateral direction of the housing is defined as L, distances between the center line L and outer circumferences of each of the air blowing ports are defined as G1, and a distance between a side surface of the housing and the outer circumference of the air blowing port is defined as G2, each of the air blowing ports is disposed at positions that satisfy $G1<G2$.

As a further preferred aspect, cylindrical bell mouths are disposed on the outer circumferences of each of the first blower and the second blower, and when the inner diameter of the bell mouth is defined as $\phi 1$ and the outer diameter of the bell mouth is defined as $\phi 2$, the distance G1 satisfies $G1 \geq (\phi 2-\phi 1)/2$.

According to the aspect of the present invention, the air blowing port of the first blower and the air blowing port of the second blower are disposed close to each other in a possible range with the center line L in the lateral direction of the housing interposed therebetween. Therefore, it is possible to effectively utilize the wind of the blower which is conventionally wasted. As a result, since the amount of air and the wind velocity distribution per unit area passing through the heat exchanger at the same rotation speed increase, it is possible to enhance the heat exchange capacity of the outdoor unit, without enlarging the blower. In addition, it is possible to reduce the current consumption of the motor for obtaining the same amount of air, and to enhance the operation efficiency of the outdoor unit, without enlarging the blower.

BRIEF DESCRIPTION OF THE DRAWINGS

FIG. 5A is a schematic diagram illustrating a state viewed from a plane side, and FIG. 5B is a schematic diagram illustrating a state viewed from a front view side.

DESCRIPTION OF EMBODIMENTS

Next, although embodiments of an outdoor unit of an air conditioner of the present invention will be described with reference to drawings, the present invention is not limited thereto.

Figure 1:
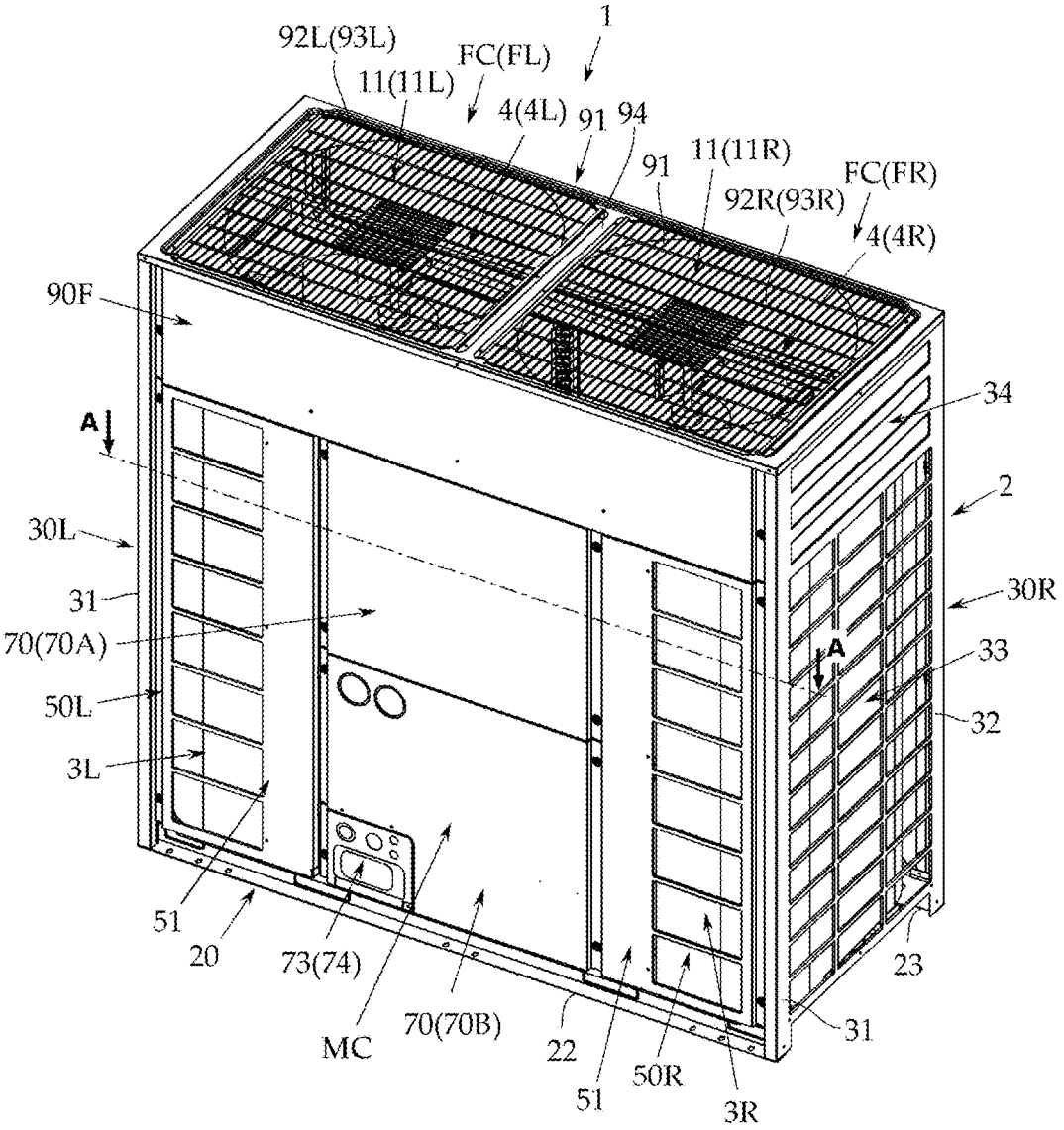
FIG. 1 is an external perspective view of a front surface side of an outdoor unit of an air conditioner according to an embodiment of the present invention.

As illustrated in FIGS. 1 to 4, an outdoor unit 1 of an air conditioner includes a rectangular parallelepiped housing horizontally elongated in a lateral direction (lateral direction in FIG. 1). An interior of the housing 2 is partitioned into a machine chamber MC having a heat exchanger 3 and a compressor (not illustrated), and a blower chamber FC having a blower 4. In the embodiment, the machine chamber MC is disposed at a lower portion in the housing 2, and the blower chamber FC is disposed above the machine chamber MC.

When viewing the lateral direction of the housing 2 in front surface in FIG. 1, a left half space of the machine chamber MC is defined as a left machine chamber ML, a right half space thereof is defined as a right machine chamber MR, a left half space of the blower chamber FC is defined as a left blower chamber FL, and a right half space of the blower chamber FC is defined as a right blower chamber FR. A first heat exchanger 3L is disposed in the left machine chamber ML of the housing 2, and a second heat exchanger 3R is disposed in the right machine chamber MR.

In addition, a first blower 4L is disposed in the left blower chamber FL, a second blower 4R is disposed in the right blower chamber FR, and a first air blowing port 11L of the first blower 4L and a second air blowing port 11R of the second blower 4R are respectively disposed on an upper surface of the housing 2.

The housing 2 is provided with a rectangular base panel 20 installed on the surface to be installed, a left side panel 30L vertically disposed at a left side end of the base panel 20, a right side panel 30R vertically disposed at a right side end of the base panel 20, a front beam 40F (refer to FIG. 4) hung horizontally between a front end of the left side panel 30L and a front end of the right side panel 30R, and a rear beam 40R (refer to FIG. 4) hung horizontally between a rear end of the left side panel 30L and a rear end of the right side panel 30R, as a basic structure.

Figure 4:
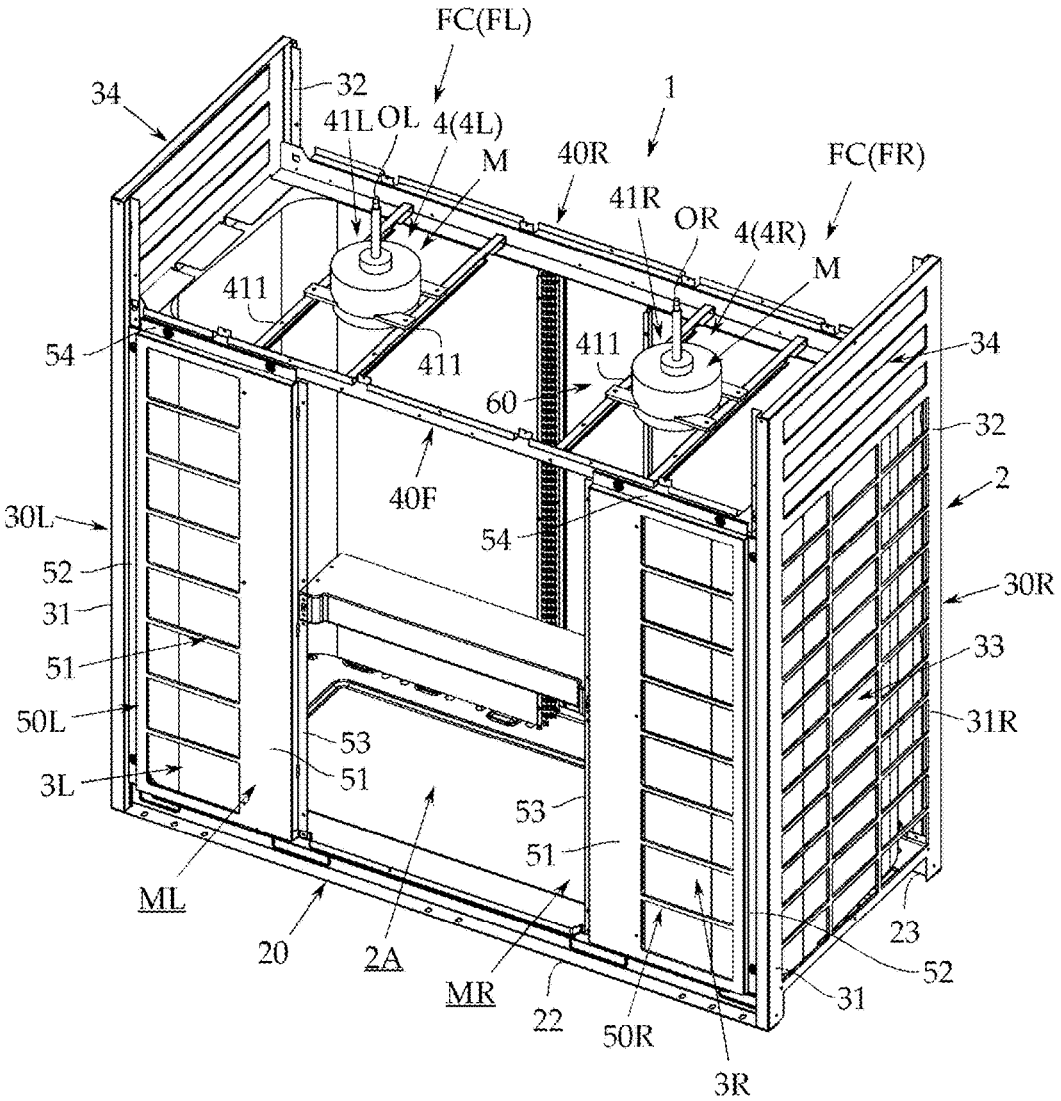
FIG. 4 is an external perspective view illustrating a state of a front surface side of a front pillar attached to a base panel, a front beam, and a side panel.

As illustrated in FIG. 4, the base panel 20 is formed by pressing or welding a steel plate, and is formed in a horizontally elongated rectangular shape. An engagement portion not illustrated in which a panel is screwed to the circumferential edge of the base panel 20 is substantially vertically disposed over the entire circumference.

On the base panel 20, a front leg 22 and a rear leg 23 are formed when the outdoor unit 1 is installed on the surface to be installed (not illustrated). The front leg 22 is bent substantially at right angle from a front end side (front side in FIG. 4) toward the lower side of the base panel 20, and is formed continuously over the right and left. The rear leg 23 is bent substantially at right angle from a rear end side (rear side in FIG. 4) toward the lower side of the base panel 20, and is formed continuously over both the right and left ends.

Figure 3:
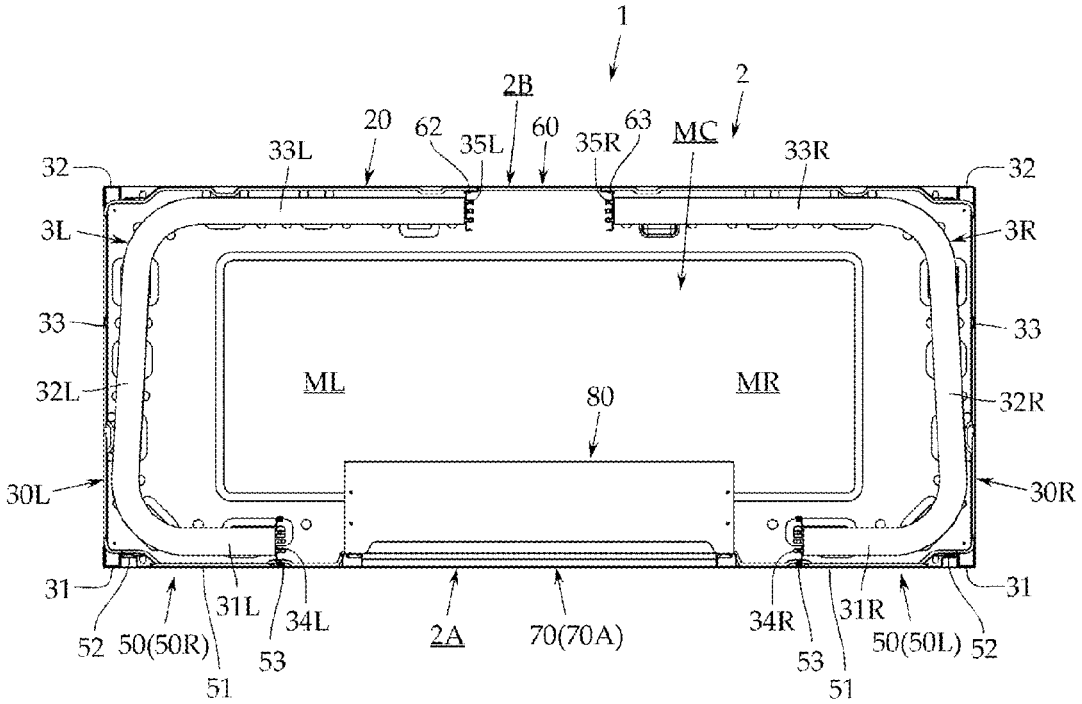
FIG. 3 is a cross-sectional view taken along line A-A of FIG. 1.

Referring to FIG. 3 together, the heat exchanger 3 includes two heat exchanger units of a first heat exchanger 3L and a second heat exchanger 3R. The first heat exchanger 3L includes a left front portion 31L disposed along a left front end of the base panel 20, a left side portion 32L disposed along the left side end of the base panel 20, and a left rear portion 33L disposed along a left rear end of the base panel 20, and is formed in a U-shape in a top view (paper direction in FIG. 3).

The first heat exchanger 3L is fixed to the base panel 20 via a first end plate 34L (hereinafter, also referred to as a front end portion 34L) attached to an end portion of the left front portion 31L, and a second endplate 35L (hereinafter, also referred to as a rear end portion 35L) attached to an end portion of the left rear portion 33L.

The second heat exchanger 3R includes a right front portion 31R disposed along a right front end of the base panel 20, a right side portion 32R disposed along the right side end of the base panel 20, and a right rear portion 33R disposed along aright rear end of the base panel 20, and is formed in a U-shape in a top view (paper direction in FIG. 3).

The second heat exchanger 3R is fixed to the base panel 20 via a third end plate 34R (hereinafter, also referred to as a front end portion 34R) attached to the end portion of the right front portion 31R, and a fourth endplate 35R (hereinafter, also referred to as a rear end portion 35R) attached to the end portion of the right rear portion 33R.

Referring back to FIGS. 1 to 4, since basic shapes of the left side panel 30L and the right side panel 30R are the same as each other, and these panels are symmetrically disposed, hereinafter, a configuration of the left side panel 30L will be described.

The left side panel 30L includes a press-formed metal plate, the width thereof is substantially the same as the length of a left end of the base panel 20, and is formed in a vertically elongated rectangular shape extending from a lower end to an upper end of the housing 2.

Figure 2:
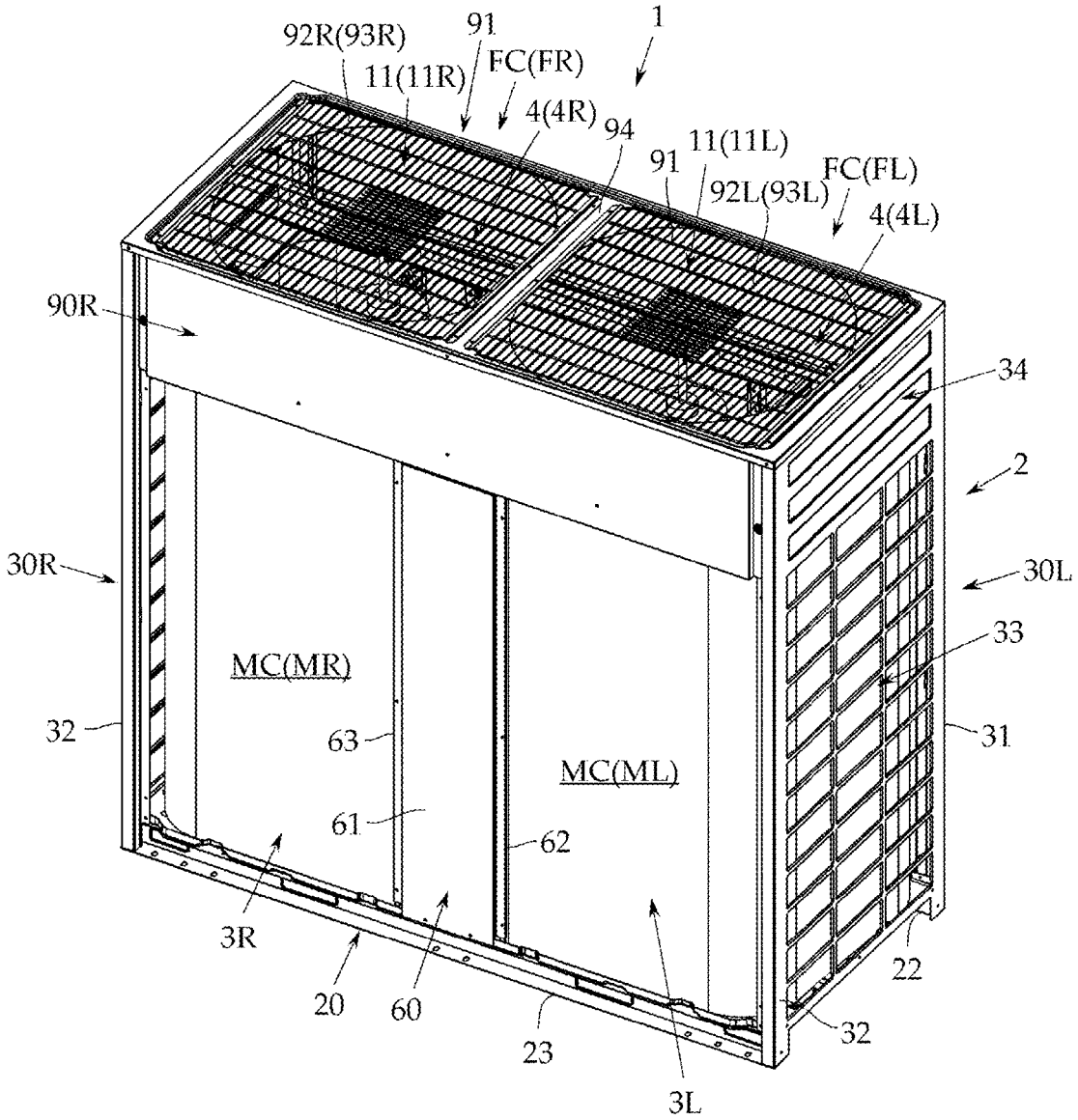
FIG. 2 is an external perspective view of a rear surface side of the outdoor unit of an air conditioner.

The left side panel 30L includes a pair of post portions 31 and 32 that engage with corner portions of the base panel 20. A grille portion 33 that protects the left side portion 32L of the first heat exchanger 3L and a panel portion 34 that closes the right side surface of the blower chamber FC in FIG. 2 are formed between the post portions 31 and 32. Since the lower ends of the post portions 31 and 32 are engaged with the side surfaces of the front leg 22 and the rear leg 23 of the base panel 20, the lower ends thereof protrude from the lower end of the left side panel 30L.

In the grille portion 33, a portion extending from the lower end to the upper end of the first heat exchanger 3L is opened in a latticed shape. The first heat exchanger 3L is adapted to be exposed to the outside via the grille portion 33. The panel portion 34 is a panel surface which closes the right side surface of the blower chamber FC.

Referring to FIG. 4, the front beam 40F includes an angle steel material having an L-shaped cross section in this example, and is horizontally hung between the post portion 31 of the left side panel 30L and the post portion 31 of the right side panel 30R. One end of the front beam 40F is screwed to the post portion 31 on the front end side of the left side panel 30L, and the other end thereof is screwed to the post portion 31 on the front end side of the right side panel 30R.

The rear beam 40R includes an angle steel material similarly having an L-shaped cross section, and is horizontally hung between the post portion 32 of the left side panel 30L and the post portion 32 of the right side panel 30R. One end of the rear beam 40R is screwed to the post portion 32 on the rear end side of the left side panel 30L, and the other end thereof is screwed to the post portion 32 on the rear end side of the right side panel 30R.

In the embodiment, the front beam 40F and the rear beam 40R are disposed along a boundary between the machine chamber MC and the blower chamber FC of the housing 2. The front beam 40F and the rear beam 40R are disposed on the same plane so as to be parallel to each other and parallel to the base panel 20.

A first motor bracket 41L that mounts the first blower 4L and a second motor bracket 41R that mounts the second blower 4R are disposed between the front beam 40F and the rear beam 40R. In the embodiment, the first motor bracket 41L is disposed in the left blower chamber FL, and the second motor bracket 41R is disposed in the right blower chamber FR.

Since the first motor bracket 41L and the second motor bracket 41R have the same configuration, hereinafter, the first motor bracket 41L will be described. The first motor bracket 41L includes a pair of beam members 411 and 411 hung in parallel between the front beam 40F and the rear beam 40R, and both ends of the beam members 411 and 411 are respectively screwed and fixed to the front beam 40F and the rear beam 40R.

A fan motor M of the blower 4L is mounted on the first motor bracket 41L, and a blower fan (not illustrated) is attached to a rotation shaft OL of the fan motor M. Similarly, a fan motor M of the blower 4R is mounted on the second motor bracket 41R, and a blower fan (not illustrated) is attached to a rotation shaft OR of the fan motor M.

Figure 5A:
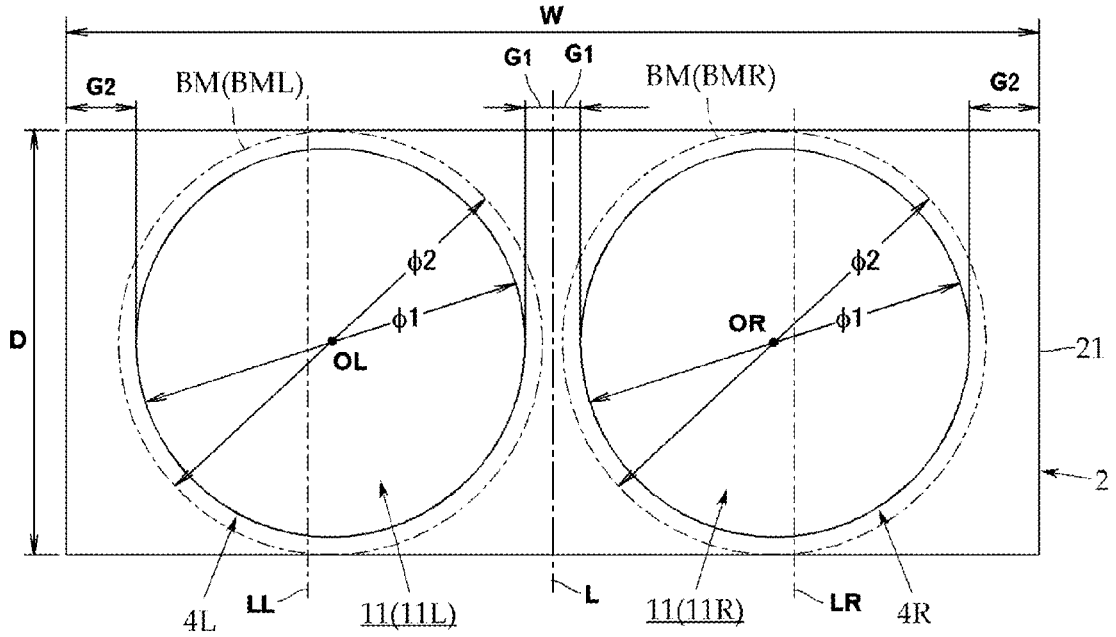
FIGS. 5A and 5B are schematic diagrams for describing a positional relationship of an air blowing port of a blower.
Figure 5B:
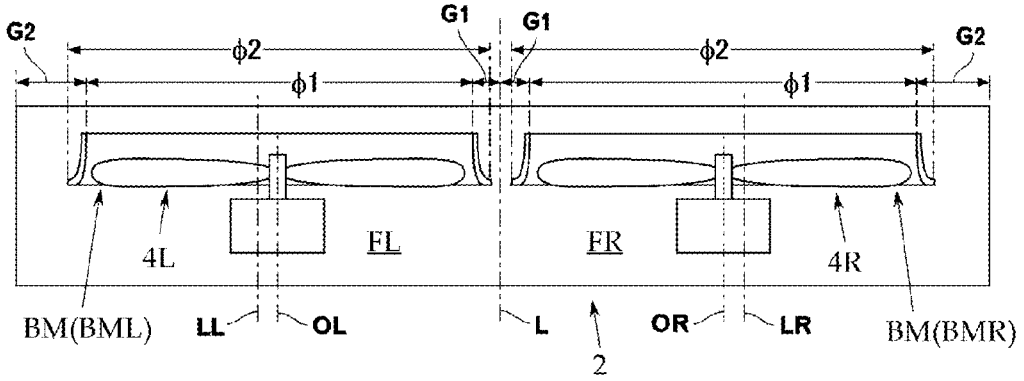

A cylindrical bell mouth BM (BML and BMR, refer to FIGS. 5A and 5B) is disposed on an outer circumference of each of the blowers 4 (4L and 4R). In the embodiment, the air blowing ports 11 (11L and 11R) correspond to the inner diameter (ϕ1 in FIG. 5B) of the bell mouth BM. In FIGS. 5A and 5B, the position of the outline of the bell mouth BM is illustrated by a dashed line.

In the embodiment, the bell mouth BM is formed so that the opening diameter of the air blowing port 11 gradually decreases as going from the lower end (lower end in FIG. 5B) to the upper end (upper end in FIG. 5B) in the axial direction. According to this configuration, as the blower 4 is driven, the air that is passed through the heat exchangers 3L and 3R from the outside surface of the housing 2 and is heat-exchanged is discharged from the air blowing port 11 to the outside of the housing 2 via the blower 4.

Additionally, in a case where two blowers 4L and 4R are mounted on the front beam 40F and the rear beam 40R, the bending moment increases from the both ends toward the center to the front beam 40F and the rear beam 40R, and there is a possibility of distortion or bending to occur in the front beam 40F and the rear beam 40R.

Therefore, in order to increase mechanical strength of the front beam 40F and the rear beam 40R, a front pillar 50 and a rear pillar 60 are disposed in the housing 2. The front pillar 50 is provided with a left front pillar 50L disposed at a front surface side of the left machine chamber ML, and a right front pillar 50R disposed at a front surface side of the right machine chamber MR.

Next, although a configuration of each of the front pillars 50L and 50R is described, since the basic configurations of the front pillars 50L and 50R are the same as each other, and have a symmetrical shape, the left front pillar 50L will be described.

The left front pillar 50L includes, for example, a single press-formed steel plate, and is formed in a vertically elongated rectangular shape. The left front pillar 50L is provided with the grille portion 51 that protects the left front portion 31L of the first heat exchanger 3L. In the embodiment, the grille portion 51 is formed in a latticed shape in which eight through holes 511 cut out squarely are disposed.

A first flange portion 52 for screwing the left front pillar 50L to the post portion 31 of the left side panel 30L is disposed at the left end of the left front pillar 50L. A second flange portion 53 to which service panels 70A and 70B and an electric component box 80 described later are attached is disposed at a right end of the left front pillar 50L. A third flange portion 54 for screwing to the front beam 40F is further disposed on the upper end of the left front pillar 50L.

A lower end side of the left front pillar 50L is screwed to the base panel 20, and the upper end side of the left front pillar 50L is screwed to the front beam 40F via the third flange portion 54, and the left front pillar 50L is further screwed in a state in which the first flange portion 52 abuts on the post portion 31 of the left side panel 40L.

As illustrated in FIG. 2, the rear pillar 60 includes, for example, a press-formed steel plate, and is formed in a vertically elongated rectangular shape in which the lower end thereof is fixed to the base panel 20, and the upper end thereof is fixed to the rear beam 40R.

The rear pillar 60 is provided with a panel body 61 on the center, that closes a rear opening portion 2B existing between the first heat exchanger 3L and the second heat exchanger 3R. The first flange portion 62 screwed to an end plate 35L of the first heat exchanger 3L is formed at the right end of the rear pillar 60 in FIG. 2. The second flange portion 63 screwed to the end plate 35R of the second heat exchanger 3R is formed at the left end of the rear pillar 60 in FIG. 2. The upper end of the rear pillar 60 is screwed to the rear beam 40R.

The lower end of the rear pillar 60 is screwed to the base panel 20, and the upper end of the rear pillar 60 is screwed to the rear beam 40R, and the first flange portion 62 is screwed to the end plate 35L of the first heat exchanger 3L, and the second flange portion 63 is screwed to the end plate 35R of the second heat exchanger 3R. Thereby, as illustrated in FIG. 2, it is possible to close the rear opening portion 2B existing between the first heat exchanger 3L and the second heat exchanger 3R with the rear pillar 60.

According to this, the two front pillars 50L and 50R are screwed between the base panel 20 and the front beam 40F and the rear pillar 60 is locked between the base panel 20 and the rear beam 40R. Therefore, the mechanical strength of the housing 2 is increased, and deformation and bending of the housing 2 can be prevented.

Although a protection grille (not illustrated) for protecting rear portions 33L and 33R of the first and second heat exchangers 3L and 3R is screwed between the rear pillar 60 and the right and left side panels 50R and 50L, since a description is particularly not required in the present invention, the description thereof will be omitted.

Referring to FIGS. 1 to 4, the space between the left front pillar 50L and the right front pillar 50R of the housing 2 is a front opening portion 2A (refer to FIG. 4) for maintenance. Accordingly, the service panel 70 is attached to the front opening portion 2A.

The service panel 70 includes two panel materials having an upper service panel 70A that closes an upper side of the front opening portion 2A, and a lower service panel 70B that closes a lower side of the front opening portion 2A.

The upper service panel 70A and the lower service panel 70B include substantially square metal panels. The left end of the upper service panel 70A and the lower service panel 70B (left end in FIG. 1) is screwed to the second flange portion 53 of the left front pillar 50L. The right end of the upper service panel 70A and the lower service panel 70B (right end in FIG. 1) is screwed to the second flange portion 53 of the right front pillar 50R.

In the embodiment, the lower left corner of the lower service panel 70B is cut in an L-shape, and a conduit panel 74 for connecting a conduit pipe (not illustrated) is fitted in a cutout portion 73 thereof.

As illustrated in FIG. 3, the electric component box 80 is disposed on a rear surface (surface facing the inside of the housing 2) of the upper service panel 70A. The electric component box 80 includes a rectangular parallelepiped box substantially equal in size to the upper service panel 70A and is screwed to the second flange portions 53 and 53 of the right and left front pillars 50R and 50L.

The front panel 90F is disposed at a front surface side (front surface side in FIG. 1) of the blower chamber FC, and a rear panel 90R is disposed at a rear surface side (front surface side in FIG. 2) of the blower chamber FC of the housing 2. Both the front panel 90F and the rear panel 90R are horizontally elongated rectangular metal panels covering the front surface side and the rear surface side of the blower chamber FC, and are respectively screwed to the side panels 30L and 30R.

A top panel 91 is attached to a top surface of the blower chamber FC. A top panel 91 includes a horizontally elongated rectangular metal frame covering the upper surface of the housing 2. A rectangular first opening portion 92L exposing the first air blowing port 11L and a square second opening portion 92R exposing the second air blowing port 11R are formed on the top panel 91. In the embodiment, reinforcing beam portions 94 are formed between each of the opening portions 92L and 92R. The protection grilles 93R and 93L are respectively screwed to each of the right and left opening portions 92R and 92L with the beam portion 94 interposed therebetween.

The feature of the present invention is that without enlarging the blower 4 along with increasing the size of the housing 2 and the heat exchanger 3, the layout thereof is reviewed and the heat exchange capacity of the outdoor unit is enhanced without enlarging the blower.

Therefore, referring to FIGS. 5A and 5B, the center line in the lateral direction (lateral direction in FIGS. 5A and 5B) of the left blower chamber FL is defined as LL, and the center line in the lateral direction (lateral direction in FIGS. 5A and 5B) of the right blower chamber FR is defined as LR. The rotation shaft OL of the first blower 4L is disposed closer to the center line L in the lateral direction of the housing 2 (rightward in FIGS. 5A and 5B) than the center line LL in the lateral direction of the left blower chamber FL. The rotation shaft OR of the second blower 4R is disposed closer to the center line L in the lateral direction of the housing 2 (leftward in FIGS. 5A and 5B) than the center line LR in the lateral direction of the right blower chamber FR.

As a more preferred aspect, when the distance between the center line L and the outer circumference of the first air blowing port 11L or the second air blowing port 11 is defined as G1, the distance between a side panel 30L of the housing 2 and the outer circumference of the first air blowing port 11L, or the distance between a side panel 30R thereof and the outer circumference of the second air blowing port 11R is defined as G2, the air blowing port 11 is disposed at a position that satisfies $G1<G2$.

As a further preferred aspect, when the inner diameter of the bell mouth BM is defined as $\phi 1$, and the outer diameter of the bell mouth BM is defined as $\phi 2$, the distance G1 is disposed so as to satisfy $G1 \geq (\phi 2-\phi 1)/2$.

According to this configuration, each of the air blowing ports 11L and 11R is disposed closer toward the center line L in the minimum range within which the bell mouth BM can be configured. Therefore, the amount of air passing through the heat exchanger at the same rotation speed increases. Accordingly, it is possible to enhance the heat exchange capacity of the outdoor unit without enlarging the blower. In addition, it is possible to reduce the current consumption of the motor for obtaining the same amount of air, and to enhance the operation efficiency of the outdoor unit, without enlarging the blower.

Application Example

Figure 6A:
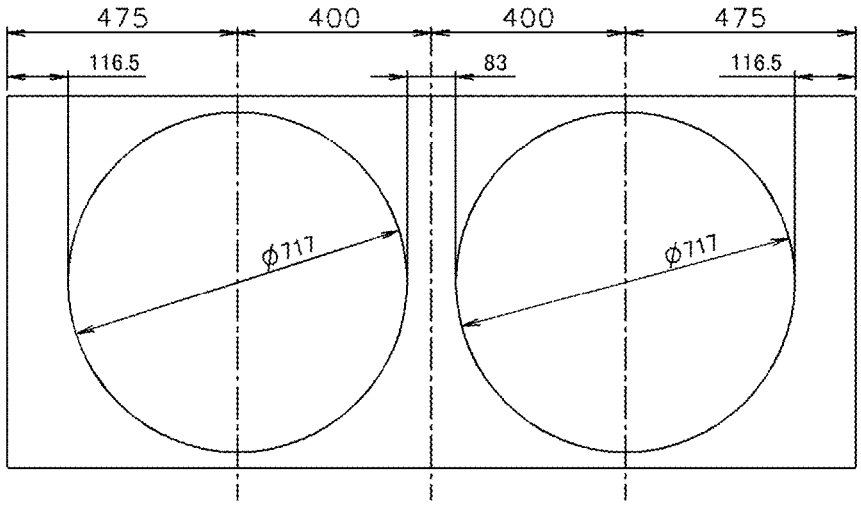
FIGS. 6A and 6B are schematic diagrams illustrating housing specifications of an application example and a comparative example.
Figure 6B:
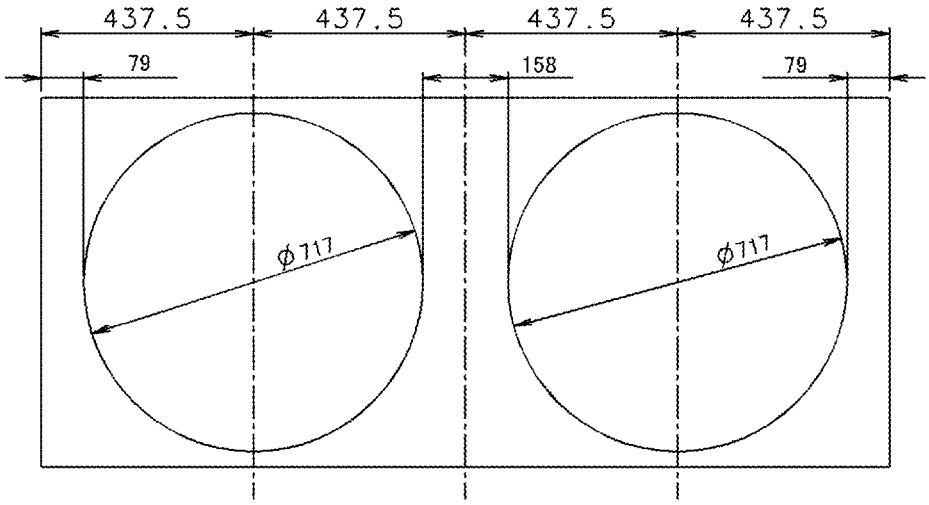

Next, the simulation result calculated based on the more specific specification of the present invention will be considered together with the comparative example. The specification of the each housing in the application example and the comparative example is illustrated in FIGS. 6A and 6B. Both the sizes (width W×depth D×height H=1750 mm×765 mm×1690 mm) of the housing 2 are the same.

Simulation Condition (1) Stationary analysis (2) A rotation speed of each of the right and left blower fans is 940 rpm.

(3) The resistance to ventilation of the heat exchanger is defined as a coefficient based on measured value.

(4) The pressure boundary is 0 Pa other than the floor surface.

(5) The air physical property value is set to a density of 1.18415 kg/m$^3$ and a viscosity coefficient of $1.85508\times10^{-5}$ Pa·s.

Simulation Contents

Figure 7:
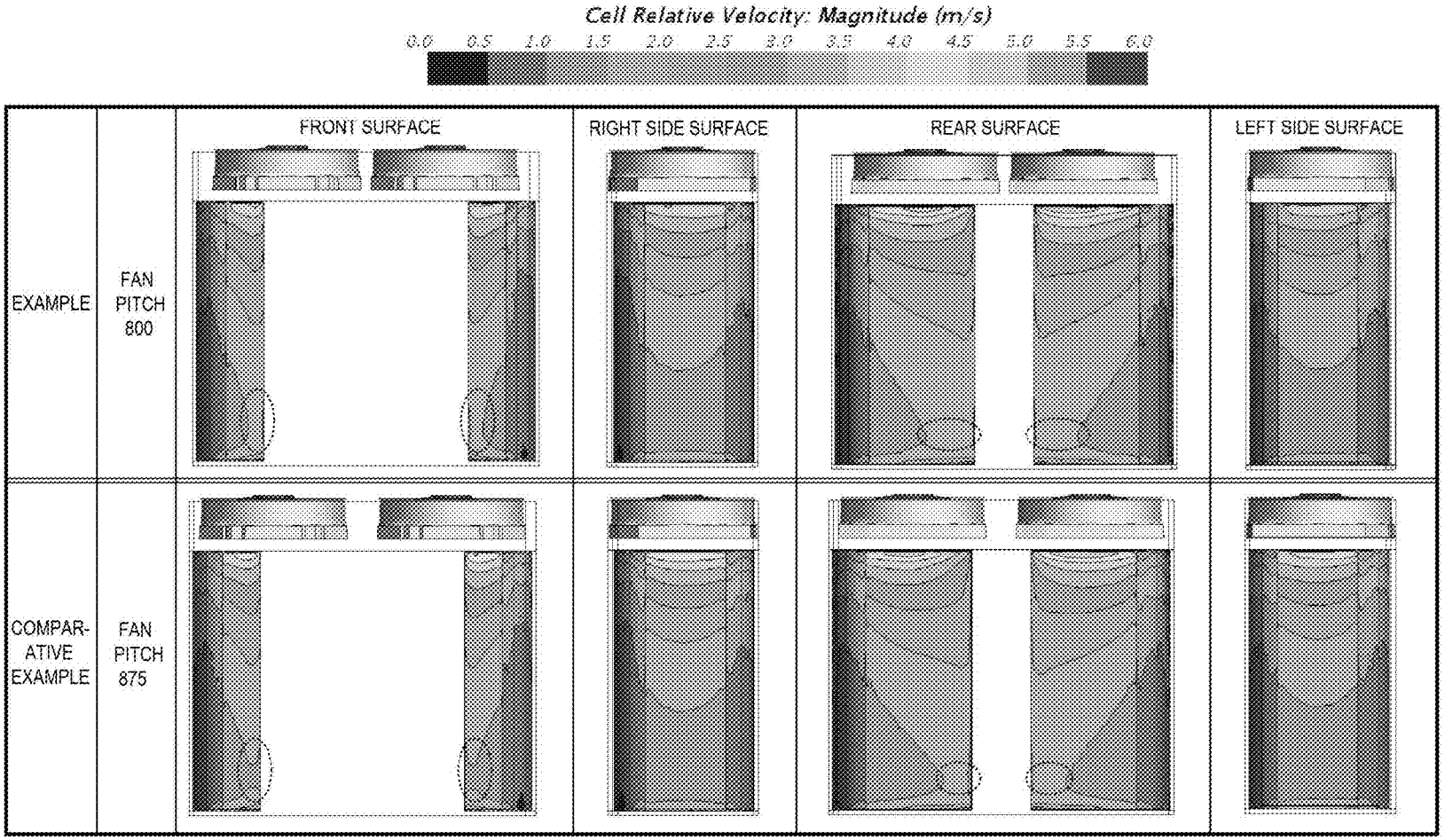
FIG. 7 illustrates wind velocity simulation data of the application example and the comparative example.
Figure 8:
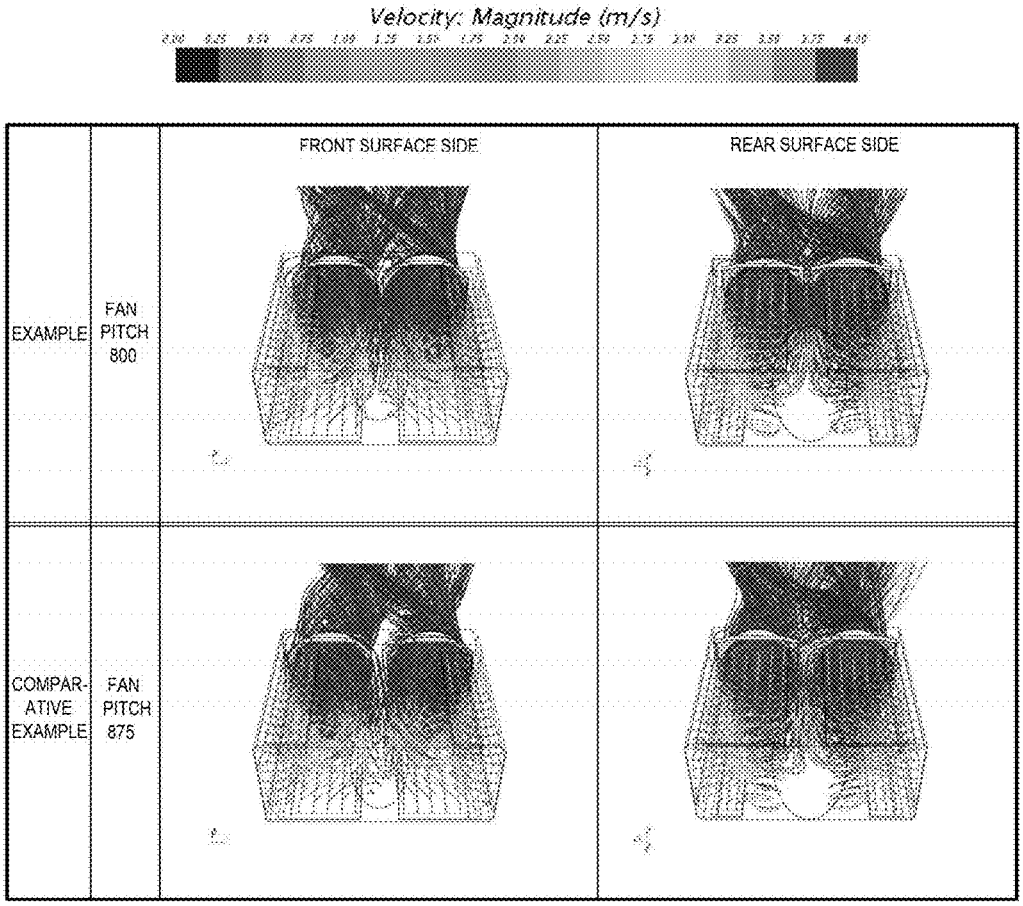
FIG. 8 illustrates wind velocity simulation data of the application example and the comparative example.

The amount of air of the air intake surface and the axial power of each of the blower fans at each of the above physical property values are calculated and the wind velocity distribution (m/s) on the heat exchanger surface is illustrated in the contour diagram (FIG. 7). In addition, the flow of air from the suction to the blowout in the interior of the housing is illustrated by a trace line (FIG. 8). Hereinafter, specification values (simulation) of the housing in the application example and the comparative example are described.

Housing Specifications in the Application Example

Width W=1750 mm
Depth D=765 mm
Height H=1690 mm
Distance G1=41.5 mm
Distance G2=116.5 mm
Inner diameter of the bell mouth ϕ1=717 mm
Outer diameter of the bell mouth ϕ2=750 mm Housing specifications in the comparative example Width W=1750 mm
Depth D=765 mm
Height H=1690 mm
Distance G1=79 mm
Distance G2=79 mm
Inner diameter of the bell mouth ϕ1=717 mm
Outer diameter of the bell mouth ϕ2=750 mm Hereinafter, FIGS. 7 and 8 illustrate the simulation results. According to this, as illustrated in FIG. 7, it is understood that the air flow at the front and rear portions of the bottom portion of the housing 2 (area surrounded by the broken line) in the application example in the region where the flow velocity is fast (portion of the light color) is increased as compared with that in the comparative example.

Furthermore, as illustrated in FIG. 8, the air flow of the bottom portion of the housing 2 (area surrounded by the broken line) on the lower side in the comparative example is rough, whereas the air in the application example is dense and it is understood that the air flow is large. According to this, the simulation result is obtained that the amount of air passing through the heat exchanger at the same rotation speed increased by approximately 2%.

As described above, according to the embodiment of the present invention, the air blowing port of the first blower and the air blowing port of the second blower are disposed close to each other in a possible range with the center line L in the lateral direction of the housing interposed therebetween. Therefore, it is possible to effectively utilize the wind of the blower which is conventionally wasted. As a result, since the amount of air and the wind velocity distribution per unit area passing through the heat exchanger at the same rotation speed increase, it is possible to enhance the heat exchange capacity of the outdoor unit, without enlarging the blower. In addition, it is possible to reduce the current consumption of the motor for obtaining the same amount of air, and to enhance the operation efficiency of the outdoor unit, without enlarging the blower.

What is claimed is:

1. An outdoor unit of an air conditioner comprising:

a housing including a base panel, an interior of the housing being partitioned into a machine chamber and a blower chamber disposed on an upper portion of the machine chamber, the blower chamber having a left blower chamber at a left half of the blower chamber and a right blower chamber at a right half of the blower chamber with respect to a center line of the housing in a lateral direction of the housing interposed therebetween, the machine chamber having a left machine chamber disposed under the left blower chamber and a right machine chamber disposed under the right blower chamber;

a first blower disposed in the left blower chamber and having a first fan, and a second blower disposed in the right blower chamber and having a second fan;

a first air blowing port disposed above the first fan of the first blower, and a second air blowing port disposed above the second fan of the second blower, the first air blowing port and the second air blowing port being symmetrically disposed on a top surface of the housing with respect to the center line of the housing; and a first heat exchanger disposed in the left machine chamber, and a second heat exchanger disposed in the right machine chamber, to face each other at end portions of the first heat exchanger and the second heat exchanger, each of the first heat exchanger and the second heat exchanger having a front portion disposed along a front surface of the base panel, a rear portion disposed along a rear surface of the base panel, and a side portion disposed along each of side surfaces of the base panel between the front portion and the rear portion to form a U-shape, the front portion of each of the first heat exchanger and the second heat exchanger having a length in the lateral direction of the housing shorter than that of the rear portion thereof, wherein a rotation shaft of the first fan of the first blower is disposed closer to the center line of the housing in the lateral direction of the housing than a center line of the left blower chamber in a lateral direction of the left blower chamber, and a rotation shaft of the second fan in the second blower is disposed closer to the center line of the housing in the lateral direction of the housing than a center line of the right blower chamber in a lateral direction of the right blower chamber; and when the center line of the housing in the lateral direction of the housing is defined as L, a distance between the center line L and an outer circumference of each of the first and second air blowing ports is defined as G1, and a distance between each of the side surfaces of the housing and the outer circumference of each of the first and second air blowing ports is defined as G2, each of the first and second air blowing ports being disposed at positions that satisfy $G1<G2$.

2. The outdoor unit of an air conditioner according to claim 1, wherein cylindrical bell mouths are disposed on outer circumferences of each of the first blower and the second blower, and when an inner diameter of each of the bell mouths is defined as ϕ1 and an outer diameter of each of the bell mouths is defined as ϕ2, the distance G1 satisfies $G1\geq(\phi2-\phi1)/2$.

3. The outdoor unit of an air conditioner according to claim 1, wherein the side surfaces include a left side surface forming the left blower chamber and the left machine chamber, and a right side surface forming the right blower chamber and the right machine chamber; and a distance between the left side surface and the rotational shaft of the first fan of the first blower is longer than a distance between the rotational shaft of the first fan of the first blower and the center line of the housing, and a distance between the right side surface and the rotational shaft of the second fan of the second blower is longer than a distance between the rotational shaft of the second fan of the second blower and the center line.

4. The outdoor unit of an air conditioner according to claim 3, further comprising a first cylindrical bell mouth separately formed from the first fan of the first blower and disposed around the first fan thereof, and a second cylindrical bell mouth separately formed from the second fan of the second blower and disposed around the second fan thereof, wherein the first cylindrical bell mouth extends inwardly in a direction toward the first air blowing port to narrow an inner diameter of the first cylindrical bell mouth, and the second cylindrical bell mouth extends inwardly in a direction toward the second air blowing port to narrow an inner diameter of the second cylindrical bell mouth.

* * * * *